US009878344B2

(12) United States Patent
Chen

(10) Patent No.: US 9,878,344 B2
(45) Date of Patent: Jan. 30, 2018

(54) COATING MACHINE FOR HYDROGRAPHICS

(71) Applicant: YUNG HUNG PRECISION MACHINERY CO., LTD., Taichung (TW)

(72) Inventor: Tai-An Chen, Taichung (TW)

(73) Assignee: YUNG HUNG PRECISION MACHINERY CO., LTD., Taichung (TW)

( * ) Notice: Subject to any disclaimer, the term of this patent is extended or adjusted under 35 U.S.C. 154(b) by 93 days.

(21) Appl. No.: 15/135,200

(22) Filed: Apr. 21, 2016

(65) Prior Publication Data

US 2017/0304862 A1 Oct. 26, 2017

(51) Int. Cl.
*B44C 1/175* (2006.01)
*B05C 1/08* (2006.01)

(52) U.S. Cl.
CPC ..... *B05C 1/08* (2013.01); *B44C 1/175* (2013.01); *B44C 1/1752* (2013.01); *B44C 1/1758* (2013.01)

(58) Field of Classification Search
CPC ..... B44C 1/175; B44C 1/1752; B44C 1/1758; B05C 1/08
USPC ..... 156/230, 240, 277, 384; 101/367
See application file for complete search history.

(56) References Cited

U.S. PATENT DOCUMENTS 6,939,585 B1 * 9/2005 Mizuta ..... B41M 3/06 118/402

FOREIGN PATENT DOCUMENTS

JP 2003236422 A * 8/2003
JP 2005081619 A * 3/2005

* cited by examiner

*Primary Examiner* — Leslie J Evanisko
(74) *Attorney, Agent, or Firm* — Lynette Wylie; Apex Juris, pllc.

(57) ABSTRACT

A coating machine has a receiving box, a releasing device, a length measuring device, a driving roller device and a coating device. The releasing device, the length measuring device, the driving roller device, and the coating device are assembled inside the receiving box. The coating device has a coating pole and a releasing set. The coating pole is arranged below the releasing set. The releasing set has a receptacle to contain an activator. The receptacle has at least one releasing hole to release the activator. The coating machine adopts the coating device with a simplified structure and has a merit of coating the activator evenly.

17 Claims, 9 Drawing Sheets

COATING MACHINE FOR HYDROGRAPHICS

BACKGROUND OF THE INVENTION

1. Field of the Invention

The present invention relates to a transfer printing apparatus, and more particularly to a coating machine for hydrographics with a simplified structure that can distribute an activator evenly.

2. Description of Related Art

Hydrographics, also known as water transfer printing, is a technique for wrapping patterns on three-dimensional objects with complex surface structures. To process hydrographics, designed patterns are first printed on a water-soluble film. An activator used to dissolve the water-soluble film and activate the bonding agent of the designed patterns is sprayed or coated on the water-soluble film with designed patterns. Then, the water-soluble film with the designed patterns and the activator is immersed into a water sink, and the water-soluble film is dissolved in the water and the designed patterns float on the water surface. Eventually, the objects are pressed into the sink and the floating designed patterns are wrapped on the objects to finish the process of printing hydrographics.

Traditional hydrographics machine has several nozzles to spray the activator, but has problems of uneven spraying amount, overlapped spraying range, and difficulty in adjustment and maintenance. The manufacturer designed another type of hydrographics machine for water transfer printing. The conventional hydrographics machine has a nozzle device to perform activator spraying. The nozzle device has a motor, a pulley mounted on the motor, a belt mounted around the pulley, and a nozzle assembled on the belt. The motor drives the pulley, and the pulley drives the belt to enable the nozzle to move back and forth to spray the activator. The conventional hydrographics machine with a single nozzle can avoid the aforementioned disadvantages of the traditional hydrographics machine. However, the conventional hydrographics machine still has problems in aspects of structural simplification and activator distribution.

To overcome the shortcomings of the conventional hydrographics machine, the present invention provides a coating machine for hydrographics to mitigate or obviate the aforementioned problems.

SUMMARY OF THE INVENTION

The main objective of the present invention is to provide a coating machine for hydrographics with a simplified structure and can distribute an activator evenly.

The coating machine comprises a receiving box, a releasing device, a length measuring device, a driving roller device and a coating device. The releasing device, the length measuring device, the driving roller device, and the coating device are assembled inside the receiving box. The coating device has a coating pole and a releasing set. The coating pole is arranged below the releasing set. The releasing set has a receptacle to contain an activator. The receptacle has at least one releasing hole to release the activator. The coating machine adopts the coating device with a simplified structure and has the merit of coating the activator evenly.

Other objects, advantages, and novel features of the invention will become more apparent from the following detailed description when taken in conjunction with the accompanying drawings.

DETAILED DESCRIPTION OF PREFERRED EMBODIMENT

Figure 1:
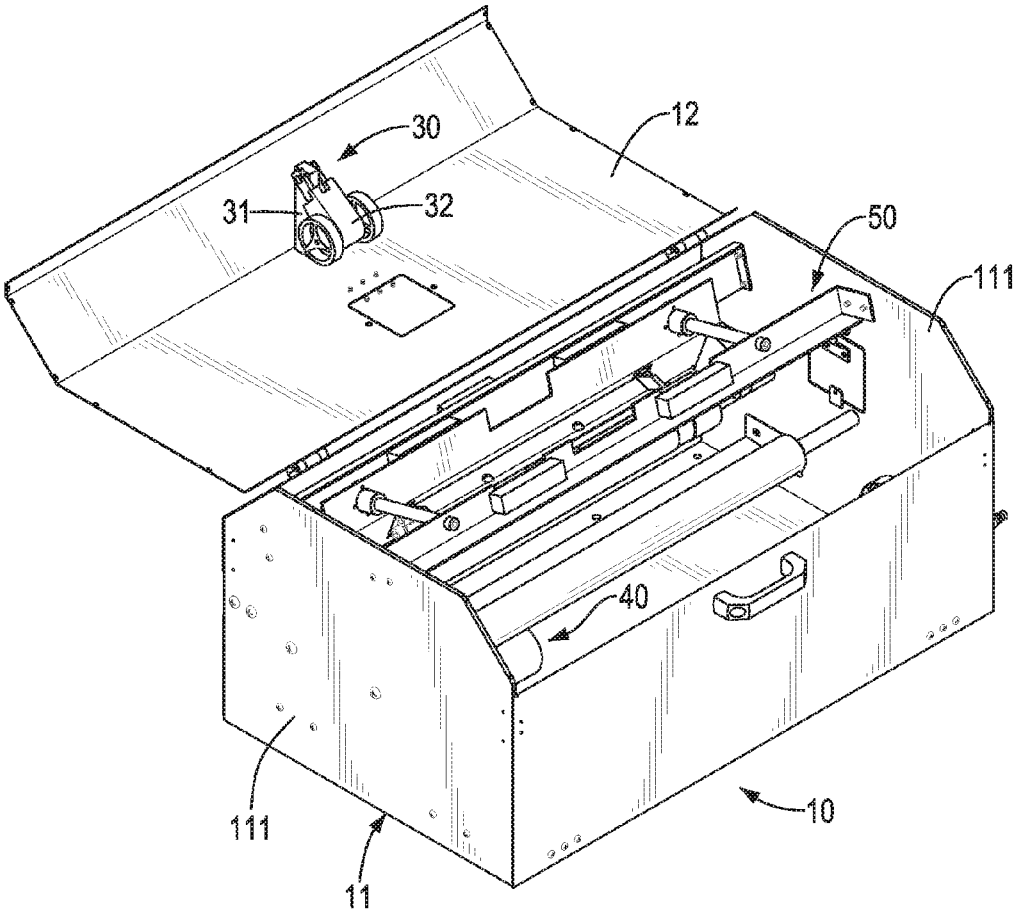
FIG. 1 is a perspective view of a first embodiment of a coating machine in accordance with the present invention, showing a cover opened.
Figure 2:
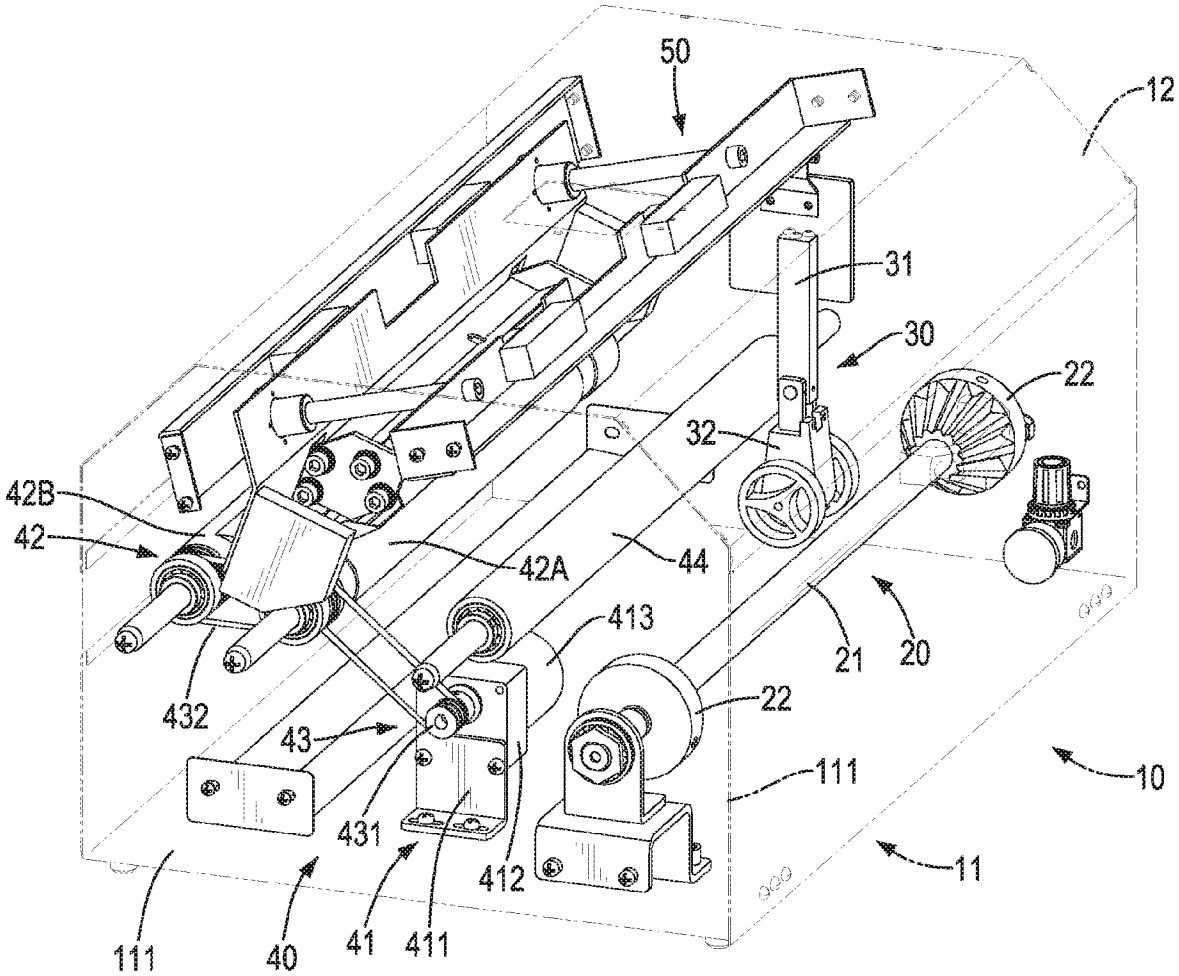
FIG. 2 is a perspective view of inner components of the coating machine in FIG. 1.
Figure 3:
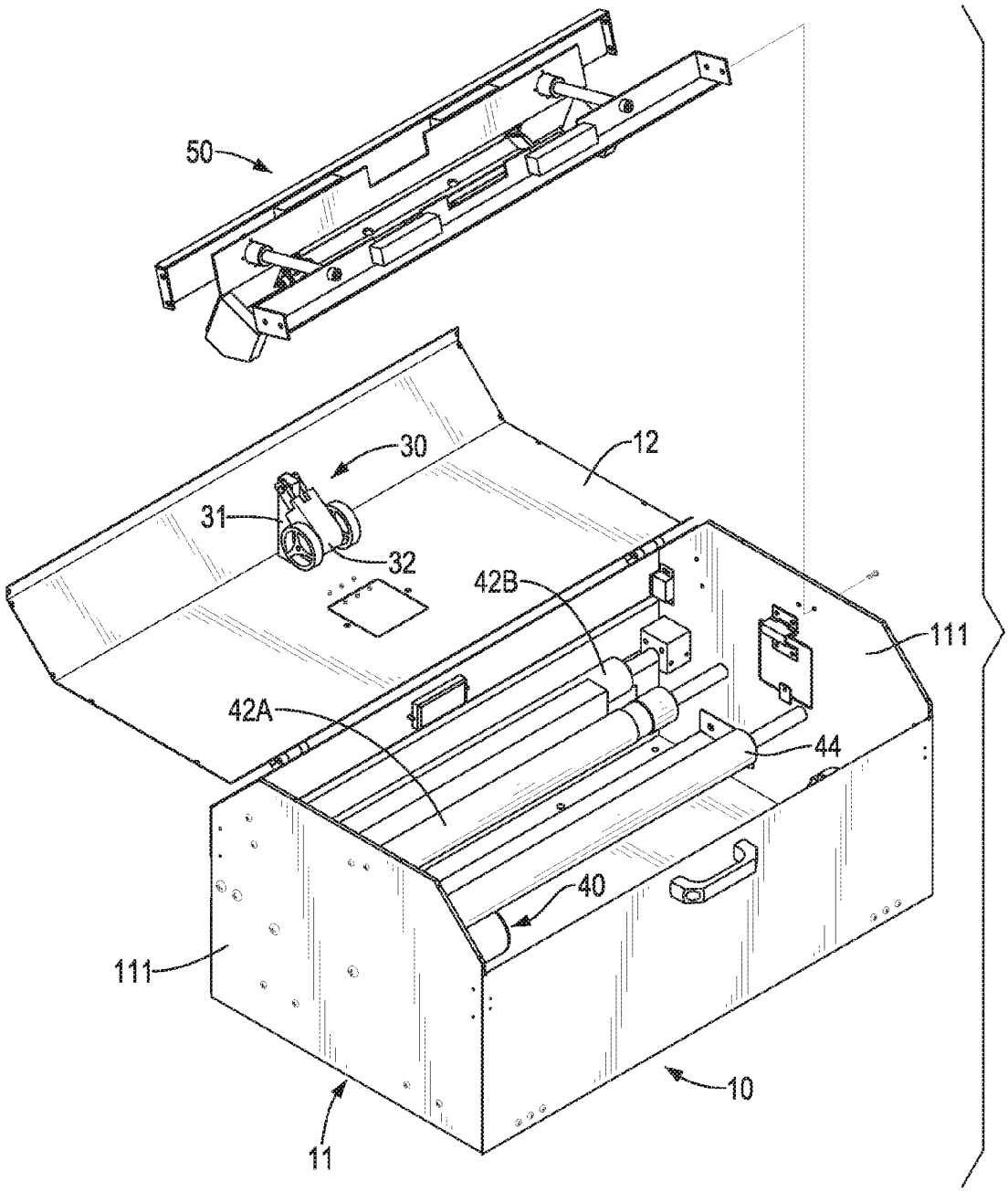
FIG. 3 is a partially exploded perspective view of the coating machine in FIG. 1.

With reference to FIGS. 1, 2, and 3, a coating machine for hydrographics in accordance with the present invention comprises a receiving box 10, a releasing device 20, a length measuring device 30, a driving roller device 40, and a coating device 50. The releasing device 20, the length measuring device 30, the driving roller device 40, and the coating device 50 are assembled inside the receiving box 10.

With reference to FIGS. 1, 2 and 3, the receiving box 10 has a box body 11 and a cover 12. The box body 11 has a front end, a rear end, two opposite sides, and two lateral boards 111. The front end and the rear end of the box body 11 are opposite each other. The two lateral boards 111 are respectively arranged on the two opposite sides of the box body 11. The cover 12 is pivotally assembled on an upper portion of the box body 11. A sink can be arranged adjacent to the rear end of the receiving box 10 to process water transfer printing.

Figure 6:
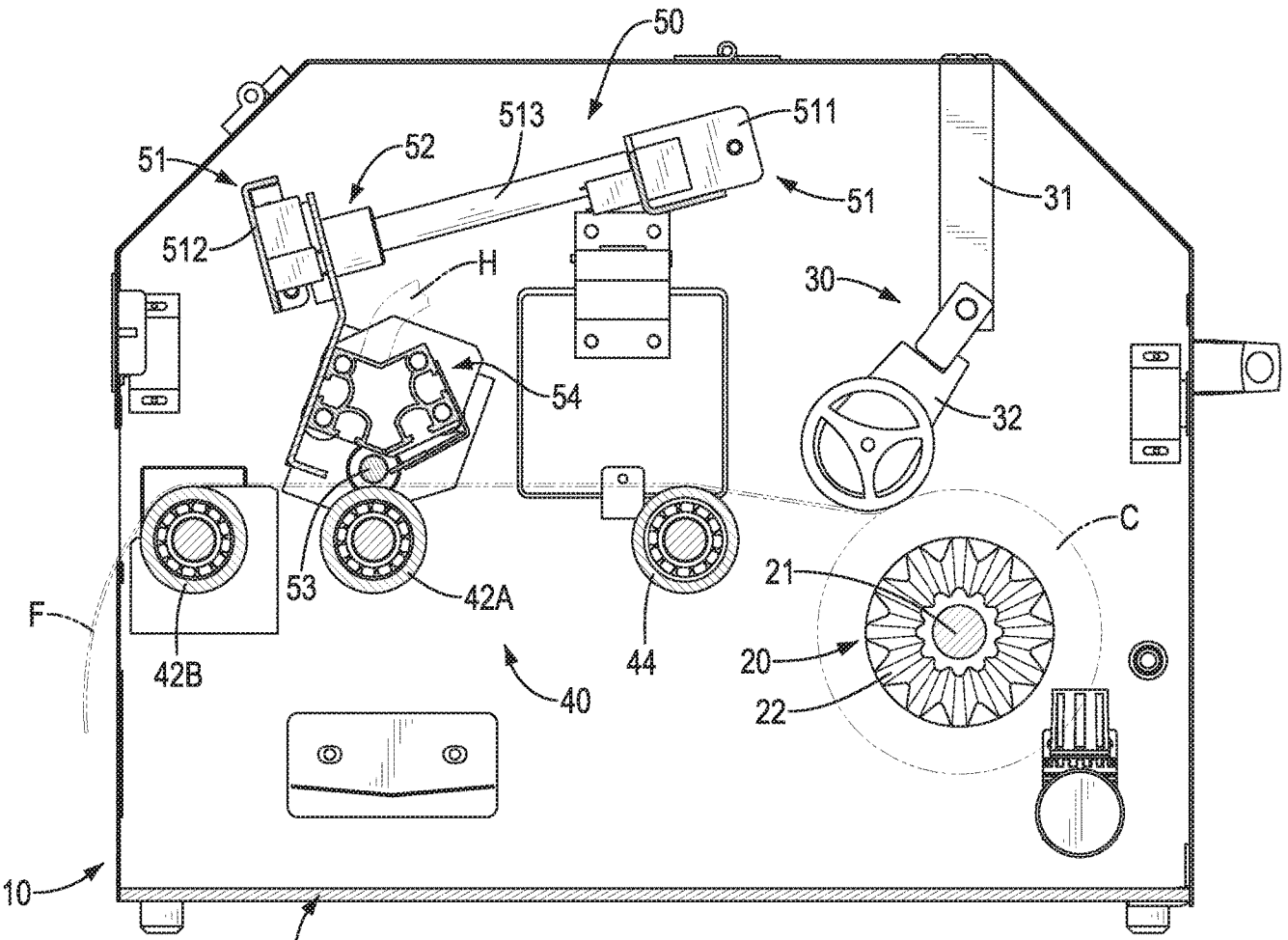
FIG. 6 is an operational side view in partial section of the coating machine in FIG. 1.

With reference to FIGS. 2 and 6, the releasing device 20 is contained inside the box body 11 and is adjacent to the front end of the box body 11. The releasing device 20 has a releasing shaft 21 and two clamping blocks 22. The releasing shaft 21 is rotatably assembled inside the box body 11 and has two opposite ends. The two opposite ends of the releasing shaft 21 respectively face to the two opposite sides of the box body 11. The two clamping blocks 22 are mounted around the releasing shaft 21 and are respectively adjacent to the two opposite ends of the releasing shaft 21. With further reference to FIG. 6, a coil stock C of water-soluble film is mounted around the releasing shaft 21. The two clamping blocks 22 are utilized to clamp the coil stock C.

With reference to FIGS. 1, 2 and 3, the length measuring device 30 has a fixing arm 31 and a meter wheel 32. The fixing arm 31 has two opposite ends. One of the two opposite ends of the fixing arm 31 is connected to the cover 12 of the receiving box 10. The meter wheel 32 is assembled at the other end of the fixing arm 31.

With reference to FIGS. 2, 3, and 6, the driving roller device 40 is contained inside the box body 11 and is behind the releasing device 20. The driving roller device 40 has a driving set 41, at least one roller 42, a transmission set 43, and a guiding roller 44. The driving set 41 has an assembling frame 411, a gear reducer 412, and a motor 413. The assembling frame 411 is mounted on the box body 11 of the receiving box 10. The gear reducer 412 is assembled on the assembling frame 411 and has a central shaft. The motor 413 is assembled on the gear reducer 412. The at least one roller 42 is adjacent to the rear end of the box body 11 and is rotatably assembled on the two lateral boards 111 of the box body 11. Each one of the at least one roller 42 has two opposite ends, and the two opposite ends of each one of the at least one roller 42 respectively face to the two opposite sides of the box body 11. The transmission set 43 has a pulley 431 and a transmission belt unit. The pulley 431 is mounted around the central shaft of the gear reducer 412. The transmission belt unit is mounted around the pulley 431 and the at least one roller 42. The at least one roller 42 is driven by the driving set 41 and the transmission set 43. In the first embodiment, the at least one roller 42 is implemented as two in amount. The two rollers 42 include a first roller 42A and a second roller 42B. The second roller 42B is adjacent to the rear end of the box body 11. The first roller 42A is in front of the second roller 42B. The transmission belt unit comprises two transmission belts 432. One of the two transmission belts 432 is mounted around the pulley 431 and the first roller 42A. The other transmission belt 432 is mounted around the first roller 42A and the second roller 42B. The guiding roller 44 is in front of the at least one roller 42 and is rotatably assembled on the two lateral boards 111 of the box body 11.

Figure 4:
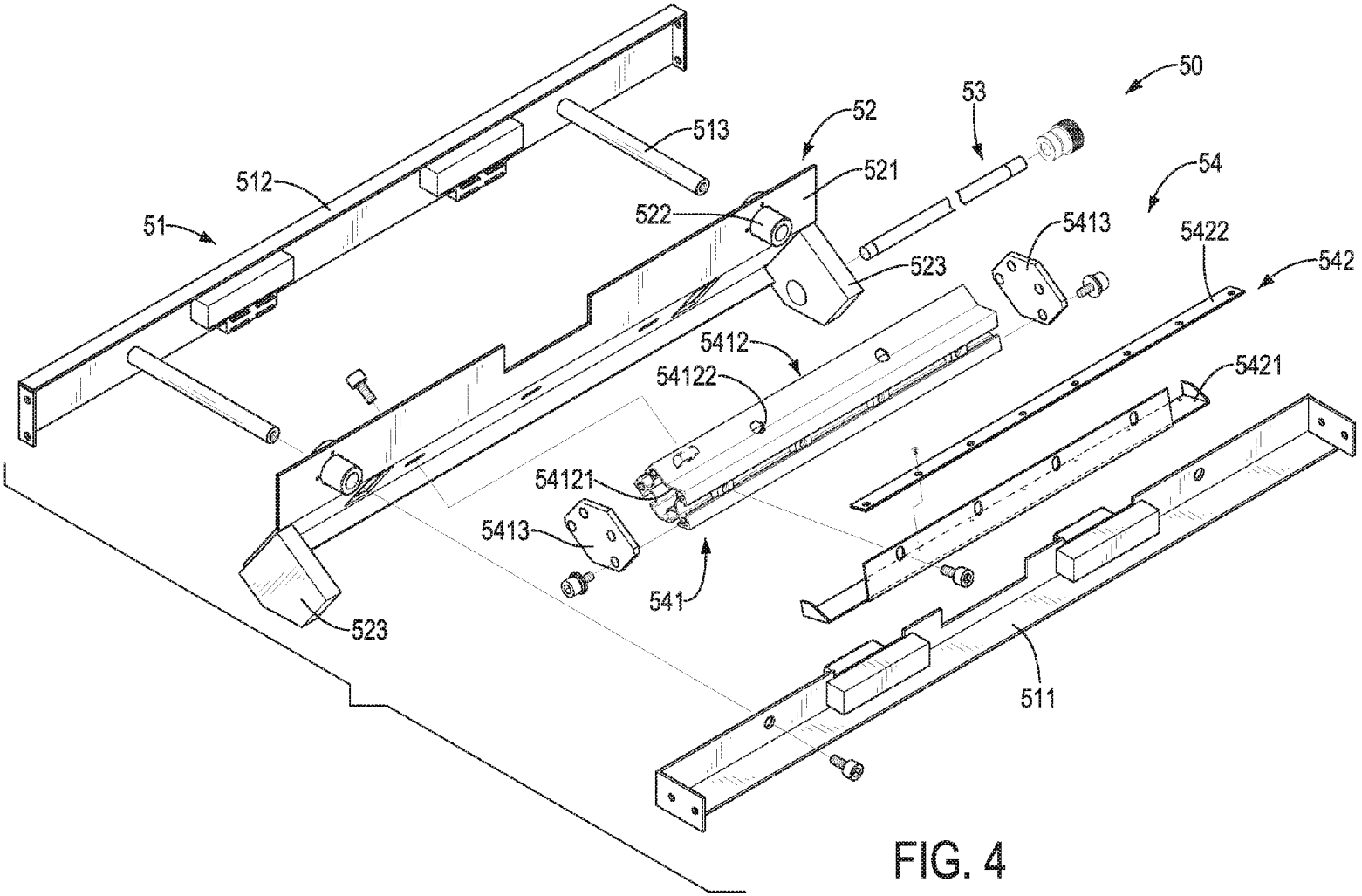
FIG. 4 is an enlarged exploded perspective view of a coating device of the coating machine in FIG. 1.

With reference to FIGS. 2, 3 and 4, the coating device 50 is contained inside the box body 11 and is arranged above the driving roller device 40. The coating device 50 has a fixed rack 51, a movable rack 52, a coating pole 53, and a releasing set 54. The fixed rack 51 has a front body 511, a rear body 512, and at least one guiding unit 513. The front body 511 has two opposite ends, and the two opposite ends of the front body 511 are respectively connected to the two lateral boards 111 of the box body 11. The rear body 512 is adjacent to the rear end of the box body 11 and has two opposite ends. The two opposite ends of the rear body 512 are respectively connected to the two lateral boards 111 of the box body 11. The at least one guiding unit 513 is arranged between the front body 511 and the rear body 512. The at least one guiding unit 513 is connected to the rear body 512 and extend toward the front end of the box body 11 to be connected to the front body 511. Each one of the at least one guiding unit 513 is a pole and has an axial section with a circular outline.

With reference to FIGS. 2, 3, and 4, the movable rack 52 is movably mounted on the at least one guiding unit 513. The movable rack 52 has a rack body 521, at least one sliding unit 522, and two assembling blocks 523. The rack body 521 has two opposite ends, and the two opposite ends of the rack body 521 respectively face to the two opposite sides of the box body 11. The at least one sliding unit 522 is connected to the rack body 521.The at least one sliding unit 522 is respectively and movably mounted on the at least one guiding unit 513. In the first embodiment, the at least one guiding unit 513 is implemented as two in amount, and the at least one sliding unit 522 is implemented as two in amount. The two sliding units 522 are two sleeves. Each one of the two sliding units 522 has a round through hole. The two sliding units 522 are connected to the rack body 521 and are respectively adjacent to the two opposite ends of the rack body 521. The two sliding units 522 are respectively mounted around the two guiding units 513, and then the movable rack 52 can move along the two guiding units 513. The two assembling blocks 523 are respectively arranged at the two opposite ends of the rack body 521.

Figures 5A, 5B:
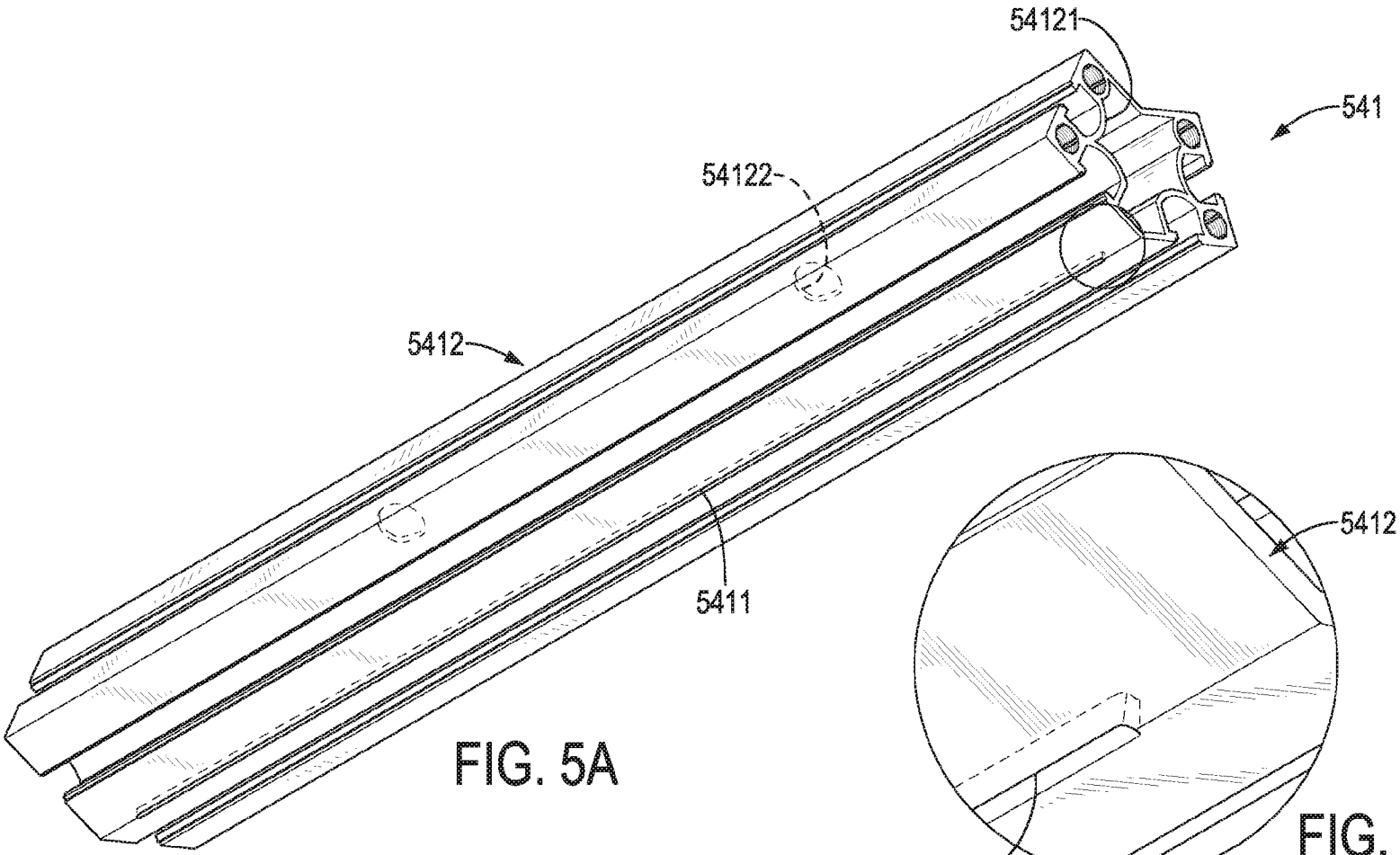
FIG. 5A is an enlarged perspective view of a receiving body of the coating device in FIG. 4.
FIG. 5B is an enlarged perspective view of a releasing hole of the receiving body of the coating device in FIG. 5A.

With reference to FIGS. 2, 4, and 6, the coating pole 53 is rotatably mounted on the movable rack 52 and has two opposite ends. The two opposite ends of the coating pole 53 respectively face to the two opposite sides of the box body 11. With reference to FIGS. 4, 5, 6, and 7, the releasing set 54 is arranged above the coating pole 53 and is mounted on the movable rack 52. The releasing set 54 has a receptacle 541 and a guiding assembly 542. The receptacle 541 has a receiving space and at least one releasing hole 5411. The at least one releasing hole 5411 is arranged on the receptacle 541 and communicates with the receiving space. The at least one releasing hole 5411 faces the coating pole 53. In the first embodiment, the receptacle 541 has a receiving body 5412 and two closed boards 5413. The receiving body 5412 is made by aluminum extrusion and has a surrounding wall and two opposite ends. The receiving body 5412 may be made of any other extruded metal materials or may be made by plastic extrusion. The two opposite ends of the receiving body 5412 respectively face to the two opposite sides of the box body 11. The receiving body 5412 has a channel 54121 and two inlets 54122. The channel 54121 is formed inside the receiving body 5412 and extends to the two opposite ends of the receiving body 5412.With reference to FIGS. 5A and 5B, the two inlets 54122 are defined in the surrounding wall of the receiving body 5412 and communicate with the channel 54121. Each one of the two inlets 54122 may be connected to a hose H for an activator to flow into the channel 54121. The two closed boards 5413 are respectively connected to the two opposite ends of the receiving body 5412 and form the receiving space between the two closed boards 5413. With reference to FIGS. 5A and 5B, in the first embodiment, the at least one releasing hole 5411 is implemented as one in amount. The releasing hole 5411 is elongated and has two opposite ends. The two opposite ends of the releasing holes 5411 respectively face to the two opposite sides of the box body 11. The guiding assembly 542 has a fastening bracket 5421 and a guiding sheet 5422. The fastening bracket 5421 is connected to the receiving body 5412. The guiding sheet 5422 is connected to the fastening bracket 5421 and extends toward the coating pole 53.

Figure 7:
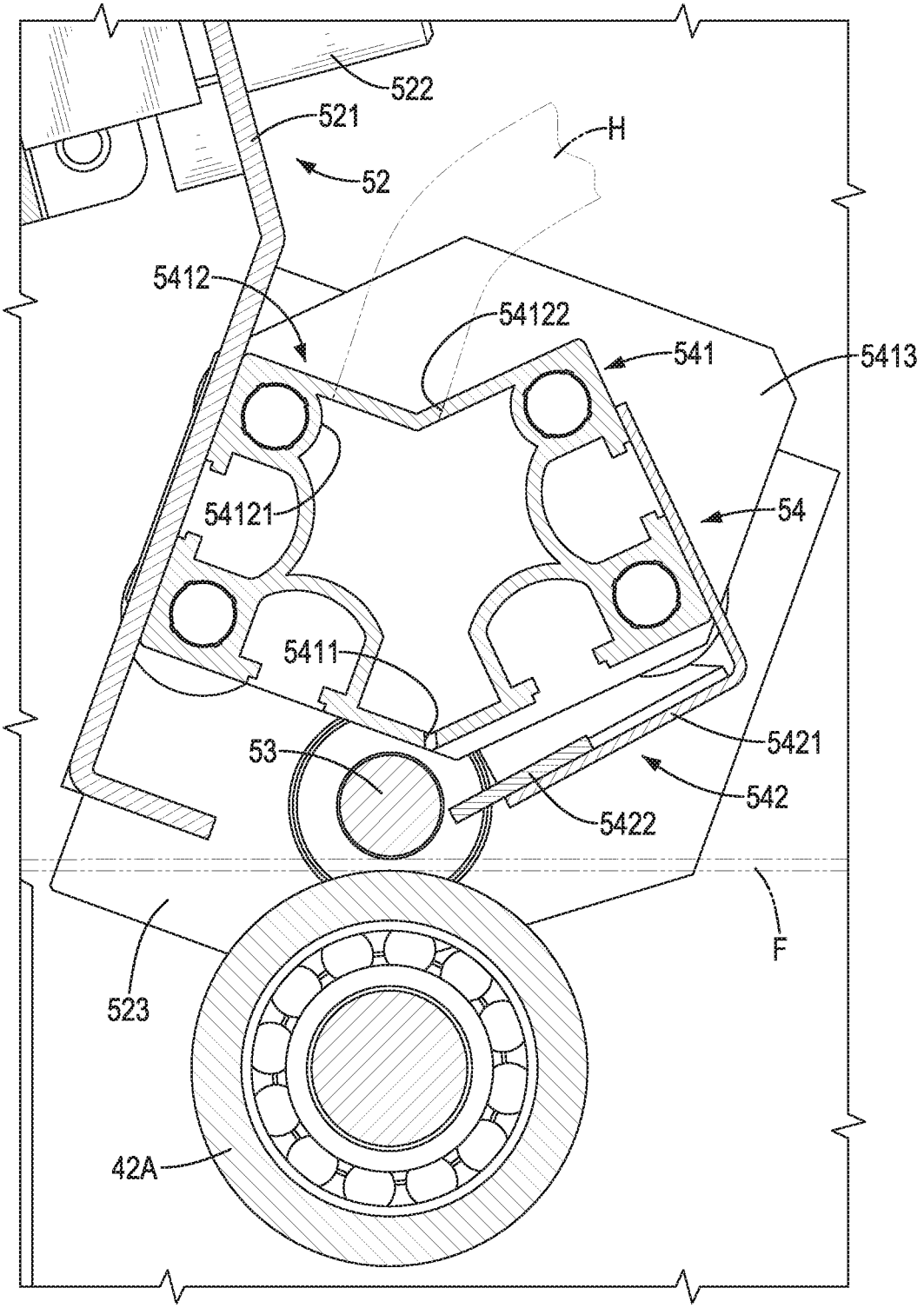
FIG. 7 is an enlarged operational side view in partial section of the coating machine in FIG. 6.
Figure 8:
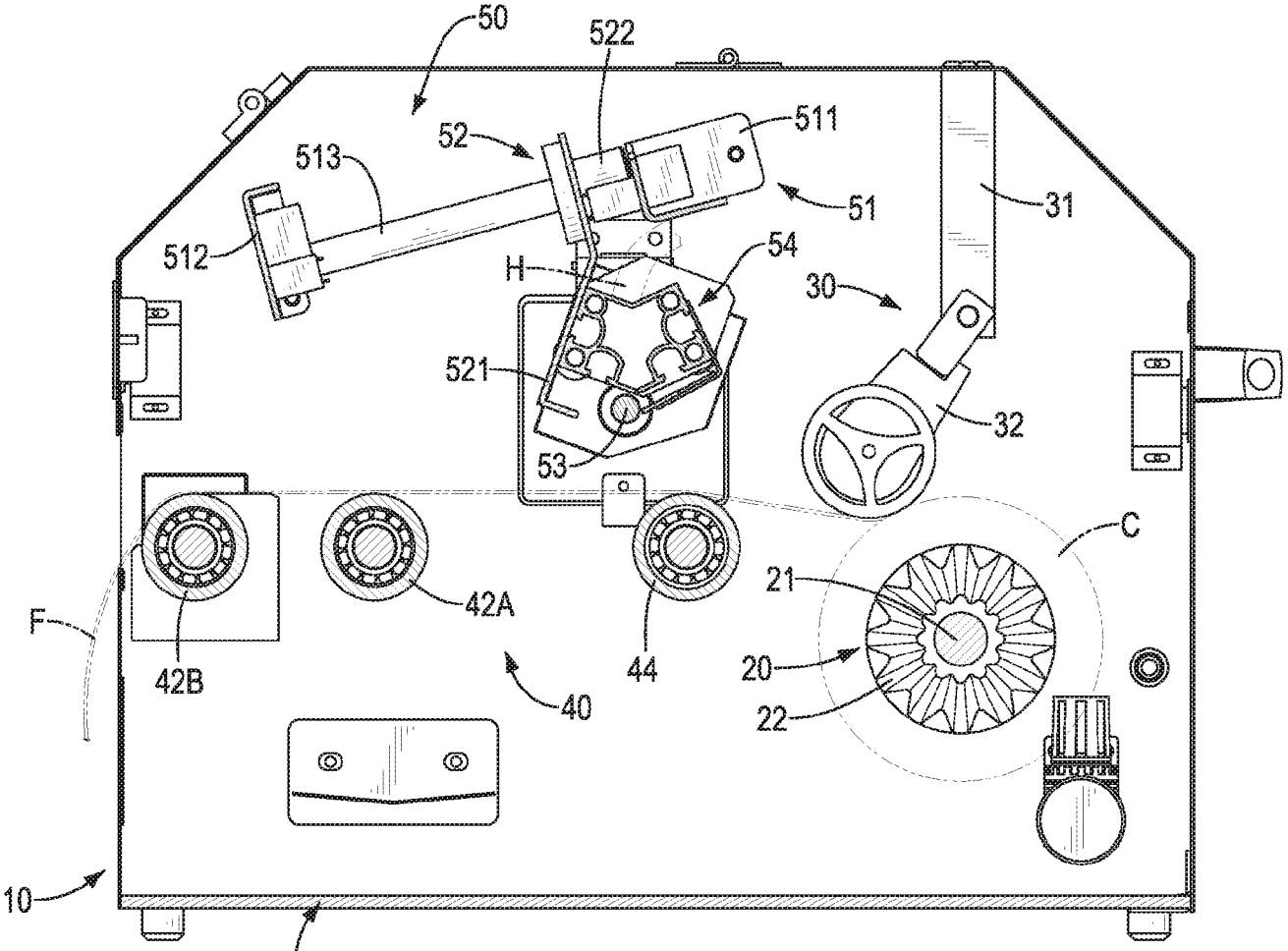
FIG. 8 is another operational side view in partial section of the coating machine in FIG. 6.

With reference to FIGS. 6 and 7, the coil stock C is mounted around the releasing shaft 21. A film F of the coil stock C is expanded to pass the guiding roller 44, the first roller 42A, the coating pole 53, the second roller 42B, and the rear end of the box body 11. The meter wheel 32 of the length measuring device 30 abuts the film F to measure the used length of the film F. The activator is injected from the two hoses H into the receptacle 541, is released from the releasing hole 5411, and is distributed on the coating pole 53. When the film F passes through the first roller 42A and the coating pole 53, the activator distributed on the coating pole 53 is coated on the film F. With reference to FIG. 8, as the film F is wrinkled, the movable rack 52 moves along the two guiding units 513 and moves toward the front end of the box body 11. Therefore, a space is formed above the driving roller device 40. The space allows adjustment and stretching of the wrinkled film F. The coating machine in accordance with the present invention replaces the complicated nozzle device that the conventional hydrographics machine adopts by the coating device 50 with a simplified structure, and has advantages of easy assembling and cost saving. The coating pole 53 of the coating device 50 evenly coats the activator on the film F, thereby further improving the distribution of the activator.

Figures 9A, 9B:
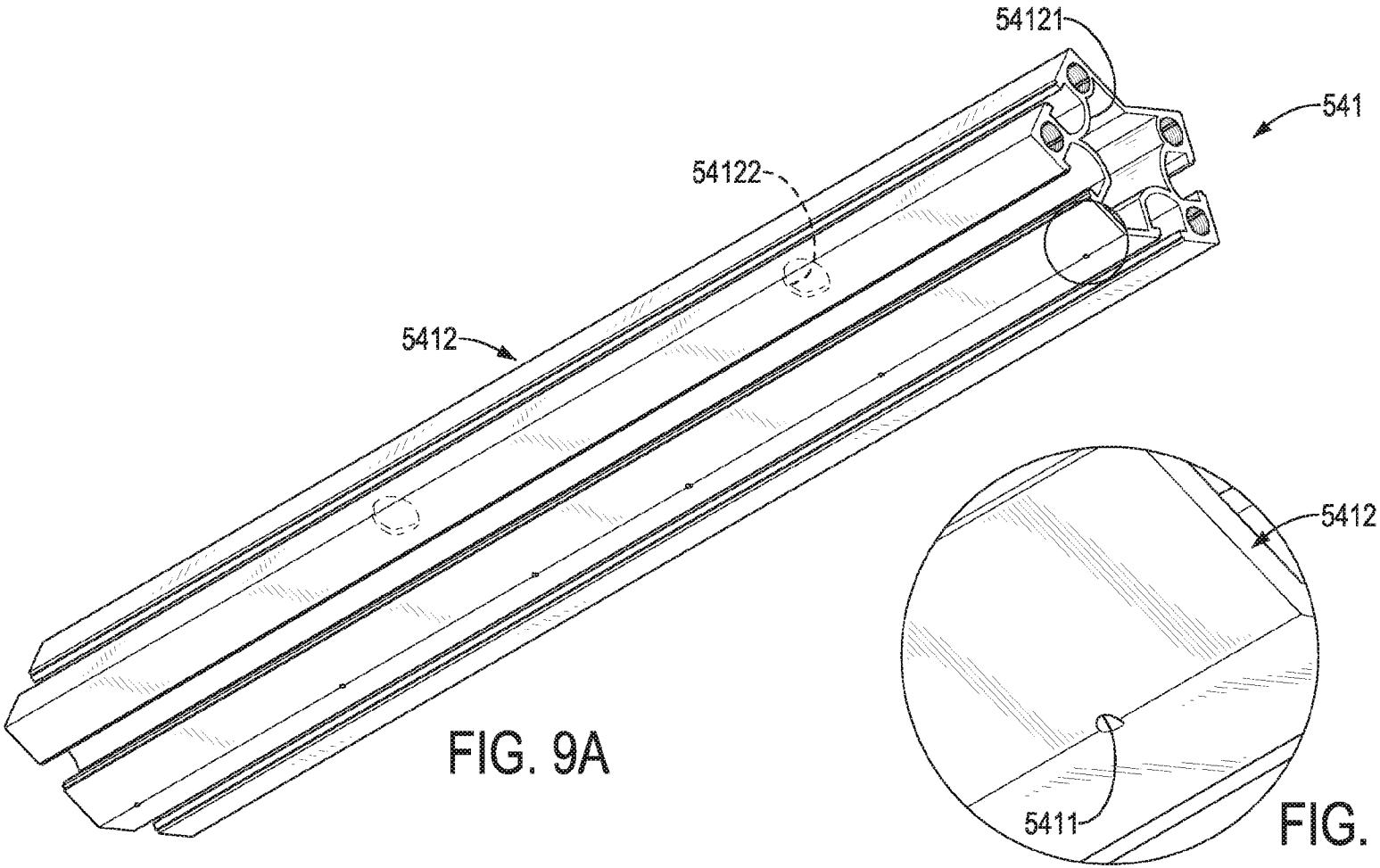
FIG. 9A is a perspective view of a second embodiment of a receiving body of a coating device of a coating machine in accordance with the present invention.
FIG. 9B is an enlarged perspective view of a releasing hole of the receiving body of the coating device in FIG. 9A.

With reference to FIGS. 9A and 9B, in the second embodiment, the at least one releasing hole 5411 is implemented as multiple in amount. The multiple releasing holes 5411 are arranged at spaced intervals and are arranged toward the two opposite sides of the box body 11.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coating machine comprising:
a receiving box having
a box body having
a front end;
a rear end opposite the front end of the box body; and
two opposite sides;
a releasing device contained inside the box body and being adjacent to the front end of the box body;
a driving roller device contained inside the box body, being behind the releasing device, and having
a driving set; and
at least one roller driven by the driving set; and
a coating device contained inside the box body, arranged above the driving roller device, and having
a fixed rack assembled on the box body and having
at least one guiding unit extending toward the front end of the box body;
a movable rack movably mounted on the at least one guiding unit;
a coating pole rotatably mounted on the movable rack and having two opposite ends respectively faced to the two opposite sides of the box body; and
a releasing set arranged above the coating pole, mounted on the movable rack, and having
receptacle having a receiving space within the receptacle; and
at least one releasing hole arranged on the receptacle, communicating with the receiving space, and facing to the coating pole.

2. The coating machine as claimed in claim 1, wherein
the at least one releasing hole is implemented as one in amount; and
the releasing hole is elongated and has two opposite ends respectively facing to the two opposite sides of the box body.

3. The coating machine as claimed in claim 2, wherein
the receptacle has
receiving body having
a surrounding wall;
two opposite ends;
a channel formed inside the receiving body and having two opposite ends respectively extending toward the two opposite ends of the receiving body;
two inlets defined in the surrounding wall of the receiving body and communicating with the channel; and
two closed boards respectively connected to the two opposite ends of the receiving body and closing respectively the two opposite ends of the channel to form the receiving space; and
the releasing hole is defined in the surrounding wall of the receiving body.

4. The coating machine as claimed in claim 3, wherein the receiving body is made by extrusion.

5. The coating machine as claimed in claim 4, wherein
the movable rack has
a rack body having two opposite ends respectively facing to the two opposite sides of the box body; and
at least one sliding unit connected to the rack body, and respectively and movably mounted on the at least one guiding unit of the fixed rack.

6. The coating machine as claimed in claim 5, wherein
the at least one guiding unit is implemented as two in amount, and the two guiding units are two poles; and
the at least one sliding unit is implemented as two in amount, and the two sliding units are two sleeves respectively mounted around the two guiding units.

7. The coating machine as claimed in claim 6, wherein
the movable rack has two assembling blocks respectively arranged at the two opposite ends of the rack body; and
the two opposite ends of the coating pole are respectively mounted on the two assembling blocks.

8. The coating machine as claimed in claim 7, wherein the releasing set has a guiding assembly having
a fastening bracket connected to the receiving body; and
a guiding sheet connected to the fastening bracket and extending toward the coating pole.

9. The coating machine as claimed in claim 1, wherein
the at least one releasing hole is implemented as multiple in amount, and the multiple releasing holes are arranged at spaced intervals.

10. The coating machine as claimed in claim 9, wherein
the receptacle has
a receiving body having
a surrounding wall;
two opposite ends;
a channel formed inside the receiving body and extending to the two opposite ends of the receiving body;
two inlets defined in the surrounding wall of the receiving body and communicating with the channel; and
two closed boards respectively connected to the two opposite ends of the receiving body, closing the channel, and forming the receiving space; and
the releasing hole is defined in the surrounding wall of the receiving body.

11. The coating machine as claimed in claim 10, wherein the receiving body is made by extrusion.

12. The coating machine as claimed in claim 11, wherein
the movable rack has
a rack body having two opposite ends respectively facing to the two opposite sides of the box body; and
at least one sliding unit connected to the rack body, and respectively and movably mounted on the at least one guiding unit of the fixed rack.

13. The coating machine as claimed in claim 12, wherein the at least one guiding unit is implemented as two in amount, and the two guiding units are two poles; and the at least one sliding unit is implemented as two in amount, and the two sliding units are two sleeves respectively mounted around the two guiding units.

14. The coating machine as claimed in claim 13, wherein the movable rack has two assembling blocks respectively arranged at the two opposite ends of the rack body; and the two opposite ends of the coating pole are respectively mounted on the two assembling blocks.

15. The coating machine as claimed in claim 14, wherein the releasing set has a guiding assembly having a fastening bracket connected to the receiving body; and a guiding sheet connected to the fastening bracket and extending toward the coating pole.

16. The coating machine as claimed in claim 1, wherein the receptacle has a receiving body having a surrounding wall;

two opposite ends;

a channel formed inside the receiving body and extending to the two opposite ends of the receiving body;

two inlets defined in the surrounding wall of the receiving body and communicating with the channel; and two closed boards respectively connected to the two opposite ends of the receiving body and closing respectively the two opposite ends of the channel to form the receiving space; and the releasing hole defined in the surrounding wall of the receiving body.

17. The coating machine as claimed in claim 16, wherein the receiving body is made by extrusion.

* * * * *